United States Patent [19]

Stange

[11] 4,330,193

[45] May 18, 1982

[54] DEVELOPMENT SYSTEM

[75] Inventor: Klaus K. Stange, Pittsford, N.Y.

[73] Assignee: Xerox Corporation, Stamford, Conn.

[21] Appl. No.: 80,650

[22] Filed: Oct. 1, 1979

[51] Int. Cl.[3] ..... G03G 15/09

[52] U.S. Cl. ..... 355/3 DD; 118/657; 118/661

[58] Field of Search ..... 355/3 R, 3 DD; 118/648, 118/651, 656, 657, 658, 661

[56] References Cited

U.S. PATENT DOCUMENTS

| | | | |
|---|---|---|---|
| 2,822,779 | 2/1958 | Schroeder | 118/657 |
| 3,064,622 | 11/1962 | Thompson | 118/637 |
| 3,233,586 | 2/1966 | Cranskens et al. | 118/637 |
| 3,318,284 | 5/1967 | Hojo et al. | 119/691 |
| 3,392,432 | 7/1968 | Naumann | 29/110 |
| 3,584,601 | 6/1971 | Turner | 118/657 |
| 3,636,926 | 1/1972 | Hodges | 118/657 X |
| 3,698,926 | 10/1972 | Furuichi | 355/3 DD X |
| 3,776,630 | 12/1973 | Ohno et al. | 118/651 X |
| 3,848,566 | 11/1974 | Stange | 118/656 |
| 3,870,017 | 3/1975 | Kratcoski et al. | 355/3 DD X |
| 3,926,516 | 12/1975 | Whited | 355/3 DD |
| 4,139,296 | 2/1979 | Ruckdeschel | 355/3 DD |
| 4,147,127 | 4/1979 | Terashima | 118/658 X |
| 4,226,524 | 10/1980 | Hashimoto | 118/657 X |

FOREIGN PATENT DOCUMENTS

| | | |
|---|---|---|
| 54-72046 | 5/1979 | Japan . |
| 54-72047 | 5/1979 | Japan . |
| 54-72048 | 5/1979 | Japan . |

*Primary Examiner*—Fred L. Braun

*Attorney, Agent, or Firm*—H. Fleischer; H. M. Brownrout

[57] ABSTRACT

Apparatus in which a plurality of spaced apart magnetic members transport developer material from a supply thereof. The spaces between adjacent magnetic members enable extraneous developer material to pass therethrough and return to the storage supply thereof.

16 Claims, 7 Drawing Figures

DEVELOPMENT SYSTEM

This invention relates generally to an apparatus for transporting a developer material. An apparatus of this type is frequently employed in the development system of an electrophotographic printing machine.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing the developer material into contact therewith. This forms a powder image on the photoconductive member which is subsequently transferred to a copy sheet. Finally, the powder image is heated to permanently affix it to the copy sheet in image configuration.

Hereinbefore, various types of development systems were employed to transport the developer material into contact with the latent image recorded on the photoconductive surface. For example, cascade systems utilize a bucket conveyor system for moving the developer material in an upwardly direction and then permitting it to cascade downwardly over the electrostatic latent image recorded on the photoconductive member. The electrostatic latent image attracts the toner particles from the carrier granules so as to form a powder image on the photoconductive member corresponding to the informational areas within the original document being reproduced. An improvement on the cascade system is the magnetic brush system. The typical magnetic brush development system employs a developer roller having a non-magnetic tubular member having the exterior circumferential surface thereof roughened. A magnetic member is mounted interiorly of the non-magnetic tubular member. Generally, the non-magnetic tubular member rotates and the developer material, which includes magnetic carrier granules, is attracted thereto. As the tubular member rotates, the toner particles and carrier granules are transported into contact with the latent image. The latent image attracts the toner particles from the carrier granules forming a toner powder image on the photoconductive surface. In addition to the developer roller, the system frequently uses paddle wheels or buckets for moving the developer material from the sump of the developer housing to the developer roller. Systems of the foregoing type are fairly expensive and complex. Thus, it is highly desirable to reduce the complexity and cost of the development system. This is particularly true when the electrophotographic printing machine is a desk or low cost type of copier. However, while it is desirable to reduce the complexity and cost of the development system, the quality and latitude of the system should, ideally, remain constant. Only in this way will the resultant copy not degradate in quality. To this end, various types of systems have been proposed which utilize only magnetic rollers. The following disclosures appear to be relevant:

U.S. Pat. No. 3,064,622; Patentee: Thompson; Issued: Nov. 20, 1962.

U.S. Pat. No. 3,233,586; Patentee: Cranskens et al.; Issued: Feb. 8, 1966.

U.S. Pat. No. 3,318,284; Patentee: Toku Hojo et al.; Issued: May 9, 1967.

U.S. Pat. No. 3,392,432; Patentee: Naumann; Issued: July 16, 1968.

Japanese Utility Model Appln. No. 52-144971; Application Date: Oct. 31, 1977; Utility Model Laid Open No. 54-72046; Laid Open Date: May 22, 1979; Applicant: Hitachi.

Japanese Utility Model Appln. No. 52-144972; Application Date: Oct. 31, 1977; Utility Model Laid Open No. 54-72047; Laid Open Date: May 22, 1979; Applicant: Hitachi.

Japanese Utility Model Appln. No. 52-144973; Application Date: Oct. 31, 1977; Utility Model Laid Open No. 54-72048; Laid Open Date: May 22, 1979; Applicant: Hitachi.

The pertinent portions of the foregoing disclosures may be briefly summarized as follows:

In FIG. 3, Thompson shows a magnet of a generally cylindrical form having alternating longitudinal flutes and ribs. Each rib is a magnetic pole of a polarity opposite to that of the next adjacent rib.

Cranskens et al. describes a roller made from a smooth annular magnet. The magnet includes a plurality of alternating north and south poles with intervening layers of non-magnetic material.

Toko Hojo et al. discloses a pair of magnetic brushes, each consisting of a plurality of permanent magnets secured to respective side faces of a non-magnetic polygon support bar.

In FIG. 3, Naumann shows a magnetic roller comprising soft iron poles having non-magnetic separating strips therebetween. Disposed interiorly of the rollers are permanent magnets of a rectangular cross-section. The magnets are mounted on a magnetizable core and extend outwardly therefrom. Non-magnetic spacers are positioned between adjacent magnets.

The Japanese Utility Model ('971) depicts a magnetic roller having magnetic pole pieces fixed in grooves in a hollow shaft.

The Japanese Utility Model ('972) discloses a magnetic roller comprising magnetic pole pieces fixed in grooves in a solid shaft.

The Japanese Utility Model ('973) describes a magnetic roller including magnetic pole pieces fixed in a hollow shaft.

In accordance with the features of the present invention, there is provided an apparatus for transporting developer material. The apparatus includes means for storing a supply of developer material. A plurality of magnetic members attract the developer material thereto. Means are provided for supporting the plurality of magnetic members so as to define a space between adjacent magnetic members. Extraneous developer material passes through the spaces between adjacent magnetic members to return to the storing means. Means move the supporting means so that the magnetic members transport the developer material from the storing means.

Other aspects of the present invention will become apparent as the following description proceeds and upon reference to the drawings, in which.

While the present invention will hereinafter be described in connection with various embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
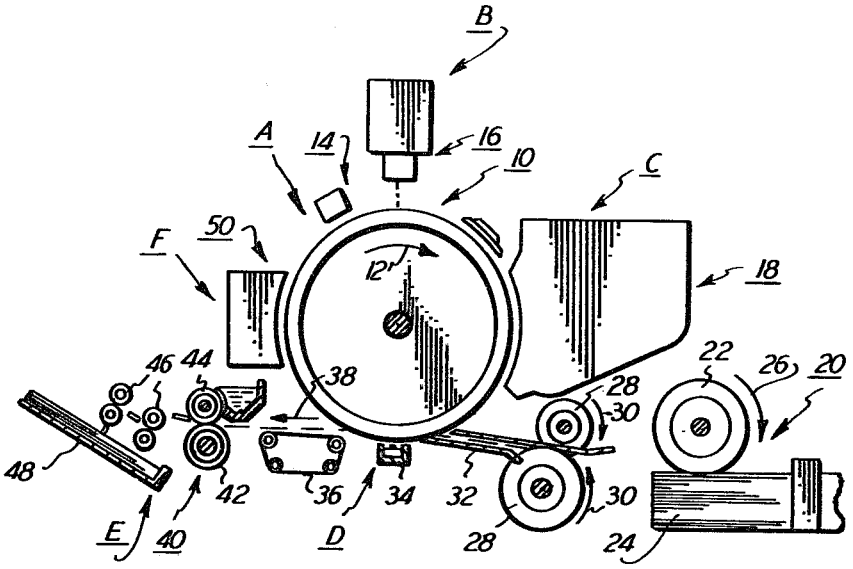
FIG. 1 is a schematic elevational view depicting an electrophotographic printing machine incorporating the elements of the present invention therein.

For a general understanding of the features of the present invention, reference is made to the drawings. In the drawings, like reference have been used throughout to designate identical elements. FIG. 1 schematically depicts the various components of an illustrative electrophotographic printing machine incorporating the development system of the present invention therein. It will become evident from the following discussion that the development system described hereinafter is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a drum, indicated generally by the reference numeral 10. Preferably, drum 10 includes a conductive substrate, such as aluminum having a photoconductive material, e.g., a selenium alloy deposited thereon. Drum 10 rotates in the direction of arrow 12 to pass through the various processing stations disposed thereabout.

Initially, drum 10 moves a portion of the photoconductive surface through charging station A. At charging station A, a corona generating device, indicated generally by the reference numeral 14, charges the photoconductive surface of drum 10 to a relatively high, substantially uniform potential.

Thereafter, the charged portion of the photoconductive surface of drum 10 is advanced through exposure station B. At exposure station B, an original document is positioned face-down upon a transparent platen. The exposure system, indicated generally by the reference numeral 16, includes a lamp which moves across the original document illuminating incremental widths thereof. The light rays reflected from the original document are transmitted through a moving lens system to form incremental width light images. These light images are focused onto the charged portion of the photoconductive surface. In this manner, the charged photoconductive surface of drum 10 is discharged selectively by the light images of the original document. This records an electrostatic latent image on the photoconductive surface which corresponds to the informational areas contained within the original document. It has been found that illuminating the charged portion of the photoconductive surface fails to totally discharge the photoconductive surface. Thus, the photoconductive surface retains background charge areas which are of some residual voltage level. For example, the background areas may have a nominal potential of about 50 volts while the electrostatic latent image or image areas may have a nominal potential of about 350 volts.

Next, drum 10 advances the electrostatic latent image recorded on the photoconductive surface to development station C. At development station C, a magnetic brush development system, indicated generally by the reference numeral 18, transports a developer material into contact with the photoconductive surface of drum 10. The developer material, or a portion thereof, is attracted to the electrostatic latent image forming a toner powder image corresponding to the informational areas of the original document.

One skilled in the art will appreciate that either single component or two component developer material may be utilized. When a single component material is used the developer material is preferably ferromagnetic granules. When two component materials are employed, the carrier granules are made preferably from a ferromagnetic material with the toner particles being made preferably from a thermoplastic material. The toner particles adhere triboelectrically to the carrier granules. During development, the toner particles are attracted to the electrostatic latent image so as to form a toner powder image on the photoconductive surface. The toner particles may be charged either positively or negatively with the potential applied to the photoconductive surface being of a polarity opposite thereto. The detailed structure of development system 18 will be described hereinafter with reference to FIGS. 2 through 7, inclusive.

Continuing now with the various processing stations disposed in the electrophotographic printing machine, after the powder image is deposited on the photoconductive surface, drum 10 advances the powder image to transfer station D.

At transfer station D, a sheet of support material is positioned in contact with the powder image formed on the photoconductive surface of drum 10. The sheet of support material is advanced to the transfer station by a sheet feeding apparatus, indicated generally by the reference numeral 20. Preferably, sheet feeding apparatus 20 includes a feed roll 22 contacting the uppermost sheet of the stack 24 of sheets of support material. Feed roll 22 rotates in the direction of arrow 26 so as to advance the uppermost sheet from stack 24. Registration rollers 28, rotating in the direction of arrow 30, align and forward the advancing sheet of support material into chute 32. Chute 32 directs the advancing sheet of support material into contact with the photoconductive surface of drum 10 in a timed sequence. This insures that the powder image contacts the advancing sheet of support material at transfer station D.

Transfer station D includes a corona generating device 34, which applies a spray of ions to the backside of the sheet. This attracts the powder image from the photoconductive surface of drum 10 to the sheet. After transfer, the sheet continues to move with drum 10 and is separated therefrom by a detack corona generating device (not shown) which neutralizes the charge causing the sheet to adhere to the drum. Conveyor 36 advances the sheet, in the direction of arrow 38, from transfer station D to fusing station E.

Fusing station E, indicated generally by the reference numeral 40, includes a back-up roller 42 and a heated fuser roller 44. The sheet of support material with the powder image thereon, passes between back-up roller 42 and fuser roller 44. The powder image contacts fuser roller 44 and the heat and pressure applied thereto permanently affixs it to the sheet of support material. Although a heated pressure system has been described for permanently affixing the particles to a sheet of support material, a cold pressure system may be utilized in lieu thereof. The particular type of fusing system employed depends upon the type of particles being utilized in the development system. After fusing, forwarding rollers 46 advance the finished copy sheet to catch tray 48. Once the copy sheet is positioned in catch tray 48, it may be removed therefrom by the machine operator.

Invariably, after the sheet of support material is separated from the photoconductive surface of drum 10, some residual particles remain adhering thereto. These residual particles are cleaned from drum 10 at cleaning station F. Preferably, cleaning station F includes a cleaning mechanism 50 which comprises a pre-clean corona generating device and a rotatably mounted fiberous brush in contact with the photoconductive surface of drum 10. The pre-clean corona generating device neutralizes the charge attracting the particles to the photoconductive surface. The particles are then cleaned from the photoconductive surface by the rotation of the brush in contact therewith. Subsequent to cleaning, a discharge lamp floods the photoconductive surface with light to dissipate any residual electrostatic charge remaining thereon prior to the charging thereof for the next successive imaging cycle.

It is believed that the foregoing description is sufficient for purposes of the present invention to illustrate the general operation of an electrophotographic printing machine incorporating the features of the present invention therein.

Figure 2:
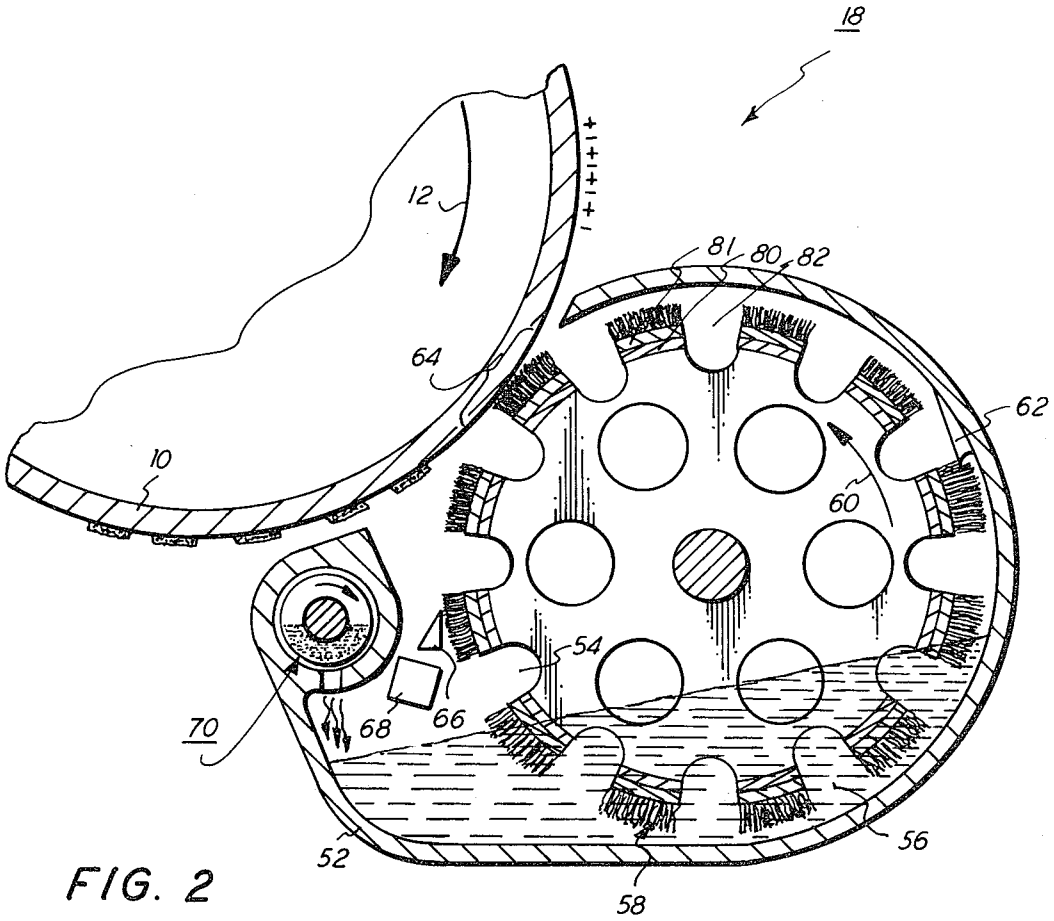
FIG. 2 is a schematic elevational view illustrating one embodiment of the development system employed in the FIG. 1 printing machine.

Referring now to the specific subject matter of the present invention, FIG. 2 depicts development apparatus 18 in greater detail. Development apparatus 18 includes a housing 52 defining a chamber 54 for storing a supply of developer material 56 therein. A developer roller, indicated generally by the reference numeral 58, is mounted rotatably within housing 52. As developer roller 58 rotates in the direction of arrow 60, it transports developer material 56 into contact with the photoconductive surface of drum 10. The developer material is magnetically attracted to the developer roll. The electrostatic latent image recorded on the photoconductive surface of drum 10 attracts the toner particles from the carrier granules so as to form a toner powder image thereon. A metering blade 62 secured to housing 52 has one edge thereof positioned closely adjacent to developer roller 58 defining a space therebetween through which the developer material passes. Metering blade 62 shears the excessive developer material from developer roller 58. The extraneous developer material is separated from developer roller 58 and returns to the lower portion of housing 52. Developer roller 58 transports the remaining developer material into contact with the latent image forming a powder image on the photoconductive surface. One skilled in the art will appreciate that one of the characteristics of developer roller 58 is self leveling. Hence, as the developer material contacts the photoconductive surface, the extraneous developer material passes through the spaces in developer roller 58 and returns to chamber 56 for subsequent reuse. Under these circumstances, the development system may not necessarily require a metering blade. Thus, the cost of the development system may further be reduced by eliminating metering blade 62.

Figure 3:
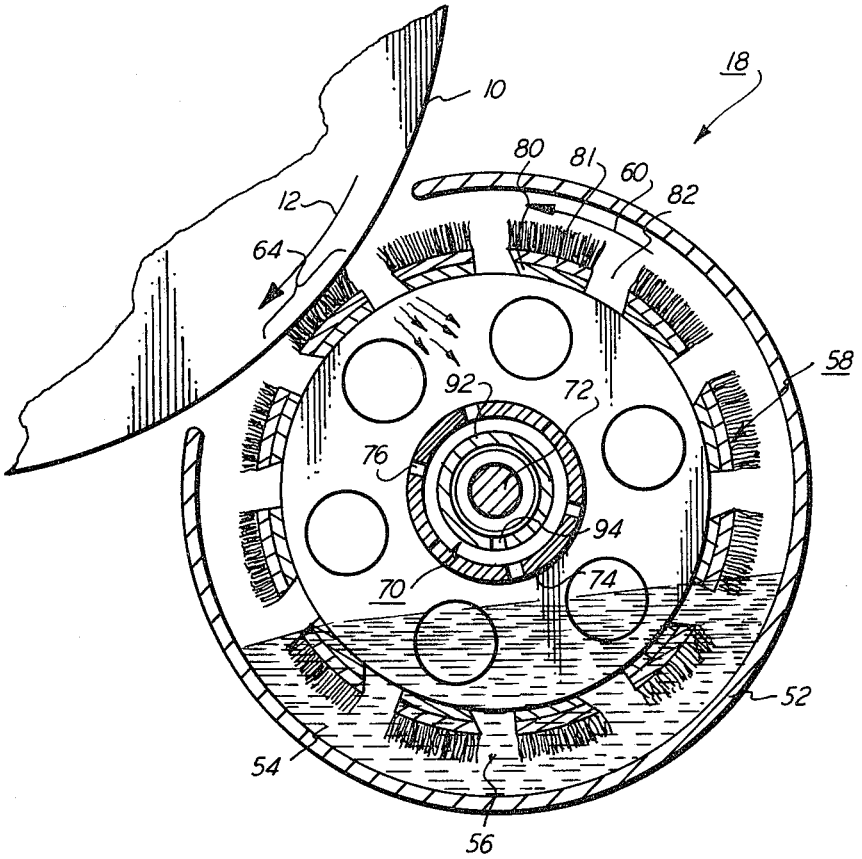
FIG. 3 is a schematic elevational view showing another embodiment of the development system used in the FIG. 1 printing machine.

With continued reference to FIG. 2, as developer roller 58 continues to rotate in the direction of arrow 60, the developer material remaining adhering thereto after passing through development zone 64 has a portion thereof separated from roller 58 by blade 66. Blade 66 splits the flow of developer material so that a portion of the developer material passes through a concentration detector 68. Concentration detector 68 measures the concentration of toner particles within the developer material. It is clear that as the toner particles are deposited on the latent image, the concentration thereof within the developer material is reduced. In order to maintain optimum copy quality, the concentration of toner particles within the developer mixture must be maintained within defined limits. When the concentration is beneath these defined limits, copy quality degradates. Hence, concentration detector 68 determines the concentration of toner particles within the developer mixture. A suitable concentration detector is disclosed in U.S. Pat. No. Re 27,480 issued to Kamola in 1972, the relevant portions thereof being hereby incorporated into the present application. In a concentration detector of this type, a light source transmits light rays through a pair of parallel electrically conductive plates. One of the plates is electrically biased to a suitable voltage to attract toner particles thereto. The intensity of the light rays transmitted through the plate is detected by a photosensor. The photosensor develops an electrical output signal which is compared by suitable logic to a reference signal. The resultant error signal is then employed to energize a toner dispenser, indicated generally by the reference numeral 70. Preferably, toner dispenser 70, includes an auger for advancing toner particles from a supply source through a tube having suitable apertures therein for discharging the toner particles into the lower portion of housing 52. Toner dispenser 70 will be described hereinafter, in greater detail, with reference to FIG. 5. As shown in FIG. 2, toner dispenser 70 is mounted externally to developer roller 58. Another embodiment showing toner dispenser 70 mounted internally of developer roller 58 is depicted in FIG. 3. In this latter embodiment metering blade 62 is omitted from the development system.

Referring now to FIG. 3, developer roller 58 rotates in the direction of arrow 60 to advance the developer material into contact with the electrostatic latent image recorded on the photoconductive surface of drum 10. Developer material 56 is stored in chamber 54 of housing 52. As the developer material is advanced into contact with the electrostatic latent image, the toner particles are attracted from the carrier granules resulting in a depletion of the toner particles within the developer material. Toner dispenser 70 positioned interiorly of developer roller 58, discharges toner particles into the developer material. As shown in FIG. 3, toner dispenser 70 is located concentrically within shaft 72 supporting developer roller 58 rotatably. In this configuration, shaft 72 has a plurality of apertures 76 permitting toner particles to be dispensed therefrom into the developer material located in chamber 54. Toner dispenser 70 is preferably a helical auger type wherein toner particles are advanced along tube 92 and discharged through openings 94 into shaft 72 so as to pass through apertures 76 therein into chamber 54 of housing 52 so as to be mixed with developer material 56. This maintains the concentration of toner particles within developer material 56 substantially constant.

Figure 4:
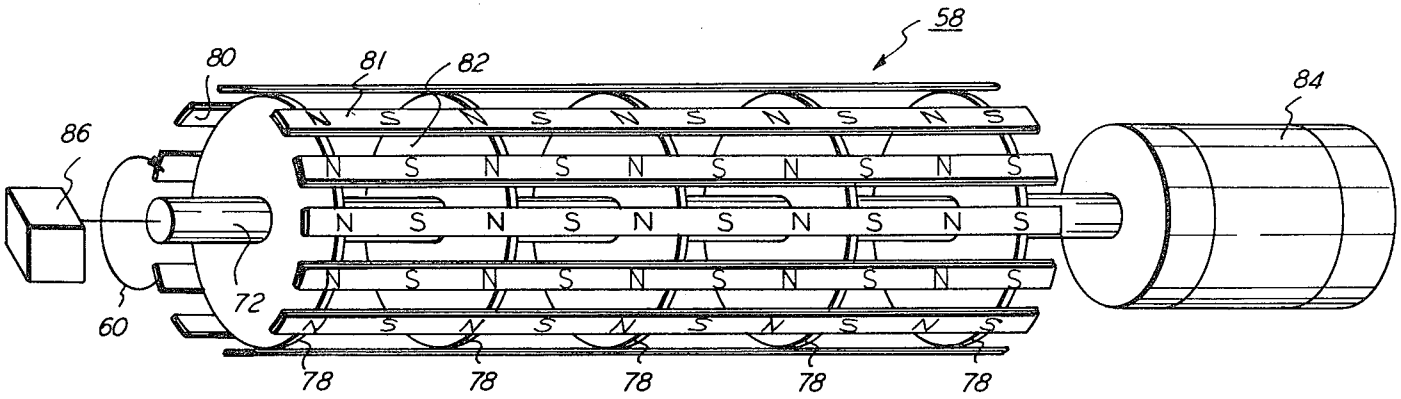
FIG. 4 is a schematic perspective view depicting the developer roller utilized in the FIG. 2 or FIG. 3 development system.

While developer roller 58 has been depicted in FIGS. 3 and 4 as rotating in a direction such that the tangential velocity thereof is in the same direction as that of drum 10, one skilled in the art will appreciate that developer roller 58 may rotate in the opposite direction such that the tangential velocity of developer roller 58 is in the opposite direction to the tangential velocity of drum 10.

Turning now to FIG. 4, there is shown the detailed structure of developer roller 58. As shown in FIG. 4, a plurality of discs 78 or spoked plates are fastened to a common shaft 72. Bars 80 are supported by discs 78. Permanent magnetic strips 81 are secured to bars 80. Bars 80 are preferably substantially equally spaced from one another defining spaces 82 therebetween. In addition, bars 80 extend in a direction substantially parallel to the longitudinal axis of shaft 72. Preferably, bars 80 are made from a soft magnetic iron which provides sufficient stiffness and support to hold the permanent magnetic strips 81 secured thereto. Magnetic strips 81 may be secured adhesively to bars 80. Spaces 82 permit the developer material to pass into the interior of developer roller 58. This allows thorough mixing of the toner particles with the carrier granules and permits extraneous developer material to escape from the nip between drum 10 and developer 58, i.e., in development zone 64 (FIG. 2). This is highly significant in that it provides for a gentle development action which significantly improves the life of the photoconductive surface. In addition, it allows for the extraneous developer material to return to the supply of developer material in chamber 54 of housing 52. The detailed structure of each magnetic strip 81 secured to bars 80 is shown also in FIGS. 2 and 3.

Motor 84 is coupled to shaft 72 so as to rotate developer roller 58 in the direction of arrow 60. Preferably, motor 84 maintains developer roller 58 rotating at a substantially constant angular velocity. Voltage source 86 is coupled via suitable means such as slip rings to shaft 72. Inasmuch as discs 78 and bars 80 are electrically conductive, voltage source 86 electrically biases developer roller 58 to a suitable potential and magnitude. Preferably, voltage source 86 electrically biases developer roller 58 to a voltage level intermediate that of the background and image areas, e.g. between 50 and 350 volts. Each magnetic strip 81 has a series of magnetic poles of alternating polarity impressed along the longitudinal axis thereof. Adjacent magnetic strips have magnetic poles of the same polarity opposed from one another. In addition, each magnetic strip is preferably electrically conductive. The electrical conductivity of the magnetic strips may be achieved by various techniques. For example, the magnetic material may be made conductive by adding carbon thereto or ceramic magnets may be employed. Alternatively, the magnetic strips may be made from rubber magnets overcoated with stainless steel foil or a carbon paint to provide the requisite conductivity. Preferably, magnetic strips 81 are made from barium ferrite.

In operation, as each magnetic strip 81 moves out of the developer material disposed in the sump of housing 52, the outer surface will be covered with a fairly uniform layer of developer material 56. As the magnetic strip moves into development zone 64, the developer material will be pulled through the development zone. Developer material which has difficulty in passing through the development zone, is merely pushed into spaces 82 between adjacent magnetic strips 81. Hence, a self-leveling feature is produced to provide gentle toning of the latent image. This self-leveling feature permits large amounts of developer material to be transported into the development zone without creating unmanageable build-ups thereof. In addition, the self leveling feature reduces the need for a metering blade. After the magnetic strip has passed through the development zone, the remaining developer material will be partially exchanged for new developer material as the strip passes, once again, through the developer material in the sump of housing 52.

Preferably, the magnetic strips have a tangential velocity which is greater than the tangential velocity of the photoreceptor. In this way, strobing effects are substantially eliminated. For example, the tangential velocity of the magnetic strips may range from about one and one-half to four times greater than the tangential velocity of drum 10. It is highly significant that the spaces 82 between adjacent magnetic strips 81 permit the developer material to pass through and away from the developing zone. Any material which does not pass through development zone simply gets pushed inside developer roller 58. This self-leveling feature is very advantageous. While discs 78 have been shown as being substantially normal to shaft 72, those discs mounted interiorly of developer roller 58 may be skewed relative to shaft 72 so as to provide cross-mixing. This arrangement is shown more clearly in FIG. 6.

Figure 5:
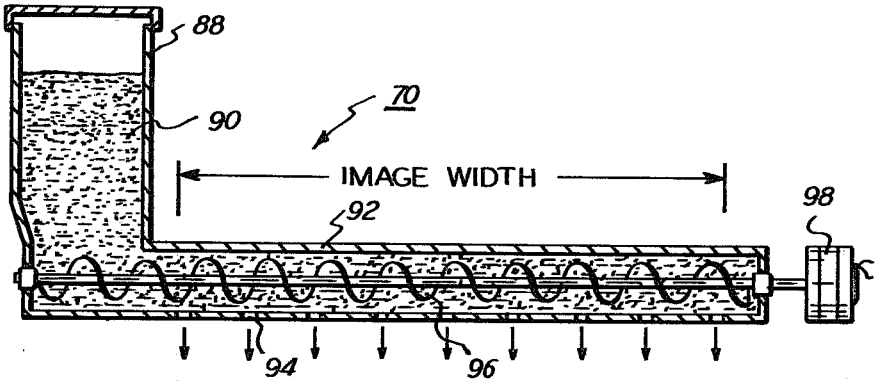
FIG. 5 is a schematic elevational view illustrating the toner dispenser used in the FIG. 2 or FIG. 3 development system.

Referring now to FIG. 5, there is shown toner dispenser 70 in greater detail. As previously noted, toner dispenser 70 may be disposed interiorly or exteriorly of developer roller 58. Toner dispenser 70 includes a supply housing 88 storing toner particles 90 therein. Housing 88 has the lower opening thereof coupled to tube 92. Tube 92 includes a plurality of substantially equally spaced apertures 94 therein. A helical auger 96 is mounted interiorly of tube 92 and rotated by motor 98. As auger 96 rotates, it advances the toner particles discharged from housing 88 along tube 92. The toner particles are dispensed from apertures 94 in tube 92. Motor 98 is actuated by concentration detector 68 heretofore described. In this way, the concentration of toner particles within the developer mixture is maintained substantially constant. A suitable toner dispenser of this type is described in U.S. Pat. No. 4,142,655 issued to Fantuzzo in 1979, the relevant portions thereof being hereby incorporated into the present application.

Figure 6:
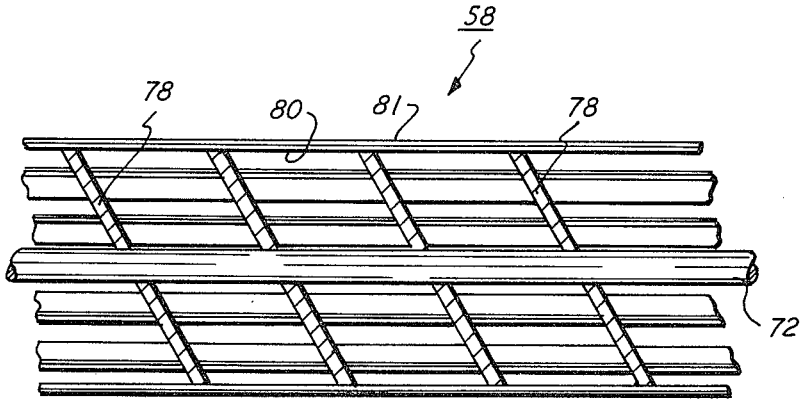
FIG. 6 is a fragmentary, schematic elevational view showing cross-mixing discs used in the FIG. 4 developer roller.

Turning now to FIG. 6, there is shown a fragmentary view of developer roller 58. As depicted thereat, discs 78 extend in a direction transverse to the longitudinal axis of shaft 72. Bars 80 are secured to the outer periphery of discs 78 and extend about the circumferential surface thereof to define a substantially cylindrical configuration. Bars 80 are equally spaced from one another. By having discs 78 positioned in an angular direction relative to shaft 72 rather than being perpendicular thereto, cross-mixing is provided. As developer roller 58 rotates, developer material is moved in a longitudinal direction i.e. substantially parallel to shaft 72 by discs 78. In this way, carrier granules and toner particles are cross-mixed with one another. Discs 78 include a plurality of apertures in the surface thereof to permit the developer material to pass therethrough in a direction substantially parallel to the longitudinal axis of shaft 72. Hence, not only does developer roller 58 transport the developer material from a supply thereof into contact with the electrostatic latent image, but it also provides cross-mixing of the toner particles and carrier granules within the developer mixer. Alternatively, fins may be secured to bars 80, discs 78, or shaft 72 to provide cross-mixing of the carrier granules and toner particles.

Figure 7:
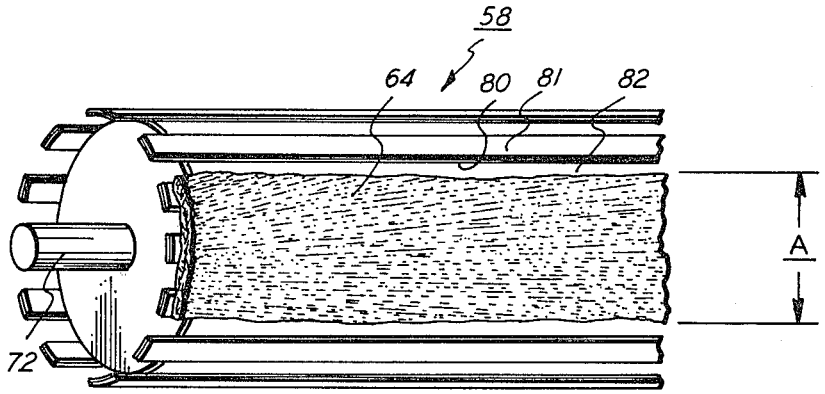
FIG. 7 is a fragmentary, schematic plan view illustrating the development zone of the FIG. 4 developer roller.

It has been found that in operation the size of development zone 64 is dependent upon the distance between magnetic strips 81 and drum 10 as well as the speed of movement of developer roller 58. As shown in FIG. 7, as the speed increases, the width A of development zone 64 increases. Similarly, as the gap or distance between drum 10 and magnetic strips 81 decreases, the width A of development zone 64 also increases. Thus, it is clear that the size of the development zone may be suitably adjusted by regulating the speed or angular velocity of developer roller 58 relative to drum 10 and/or the gap between the magnetic strips and the photoconductive drum. An example of an extreme case is when drum 10 is stationary and the velocity of the magnetic strips was about 50.8 centimeters per second with the distance between drum 10 and the magnetic strips being about 1.27 centimeters, the width A of development zone 64 was found to be approximately 2.54 centimeters. It is thus clear that the development zone may be maintained reasonably wide so as to provide a considerable duration of time for the toner particles to migrate from the carrier granules to the electrostatic latent image rendering the latter visible.

In recapitulation, it is clear that the improved development system of the present invention provides a relatively wide development zone while handling the developer material in a substantially gentle manner to optimize development of the electrostatic latent image recorded on a photoconductive drum. The developer roller includes an array of strip magnets arranged in a cylindrical envelope with spaces between adjacent magnets. The spaces between the magnets allow excessive developer material in the development zone to escape therefrom and permits the interior of the cylindrical structure to be utilized as a sump while having cross-mixing and toner dispensing structures disposed therein. With a developer roller of this type, a large excess of developer material can be transported to the development zone, the development zone is fairly wide and mechanical tolerances are relaxed. A developer roller of this type utilizes inexpensive light weight magnets to produce significant cost savings while being of a smaller overall size and lighter weight than conventional systems hereinbefore been developed.

It is, therefore, evident that there has been provided, in accordance with the present invention, an apparatus for developing an electrostatic latent image recorded on a photoconductive surface which fully satisfies the aims and advantages hereinbefore set forth. While this invention has been described in conjunction with specific embodiments thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An electrophotographic printing machine of the type in which an electrostatic latent image recorded on a photoconductive member is developed with a developer material, wherein the improvement includes:

means for storing a supply of developer material;

a plurality of elongated magnetic members for attracting the developer material thereto;

means for rigidly supporting said magnetic members with adjacent magnetic members being spaced from one another and the longitudinal axes thereof substantially parallel to one another so that said magnetic members form the exterior circumferential surface of a cylindrical configuration defining an interior chamber with developer passing between adjacent magnetic members to the interior chamber and returning to said storing means, said supporting means being positioned relative to the photoconductive member to define a pre-selected gap between said magnetic members and the photoconductive member; and means for moving said supporting means so that said magnetic members transport the developer material from said storing means into contact with the latent image recorded on the photoconductive member so as to deposit developer material on the photoconductive member in image configuration, said moving means moving said supporting means at a preselected velocity relative to the photoconductive member to maintain the area of developer material contacting the photoconductive member at a preselected size.

2. A printing machine as recited in claim 1, wherein each of said plurality of magnetic members includes a magnetic strip with each of said magnetic strips being substantially parallel to one another.

3. A printing machine as recited in claim 2, wherein each of said supporting means includes:

at least a pair of spaced apart discs; and a plurality of spaced apart bars connecting said pair of discs to one another with each of said plurality of bars being arranged to support one of said magnetic strips.

4. A printing machine as recited in claim 3, wherein said plurality of bars are equally spaced from one another.

5. A printing machine as recited in claim 4, wherein each of said plurality of bars are connected to the outer periphery of said pair of discs to define the cylindrical configuration.

6. A printing machine as recited in claims 1 or 5, further including means for metering the quantity of developer material being transported by said plurality of magnetic members.

7. A printing machine as recited in claim 6, wherein said metering means includes a blade member having the leading edge thereof spaced from said plurality of magnetic members to define a gap controlling the quantity of developer material passing therethrough.

8. A printing machine as recited in claims 2 or 5, wherein opposed magnetic poles extending longitudinally along adjacent ones of said plurality of magnetic strips have the same magnetic polarity.

9. A printing machine as recited in claim 1 or 5, wherein each of said plurality of magnetic members are electrically conductive.

10. A printing machine as recited in claims 1 or 5, wherein the developer material includes:

magnetic carrier granules; and non-magnetic toner particles adhering triboelectrically to said carrier granules.

11. A printing machine as recited in claim 10, further including means for dispensing toner particles into said storing means.

12. A printing machine as recited in claim 11, further including means for detecting the concentration of toner particles in the developer material and actuating said dispensing means to discharge additional toner particles into the developer material in said storing means in response to the toner particle concentration being beneath a pre-determined level.

13. A printing machine as recited in claim 11, wherein said dispensing means is positioned interiorly of said supporting means.

14. A printing machine as recited in claims 1 or 5, wherein the developer material includes magnetic particles.

15. A printing machine as recited in claim 5, wherein each of said plurality of bars are magnetic.

16. An apparatus as recited in claims 1 or 5, further including means for electrically biasing said plurality of magnetic members to a pre-determined voltage level.

* * * * *